United States Patent [19]

Panetti

[11] Patent Number: 4,920,701

[45] Date of Patent: May 1, 1990

[54] DEVICE FOR THE REPROFILING OF THE RAILS OF A RAILWAY TRACK

[75] Inventor: Romolo Panetti, Geneva, Switzerland

[73] Assignee: Speno International S.A., Geneva, Switzerland

[21] Appl. No.: 304,193

[22] Filed: Jan. 31, 1989

[30] Foreign Application Priority Data

Mar. 4, 1988 [CH] Switzerland ..... 817/88

[51] Int. Cl.[5] ..... E01B 31/17

[52] U.S. Cl. ..... 51/165.71; 51/178

[58] Field of Search ..... 51/178, 165.71, 72 R, 51/74 R, 80 R; 364/474.06

[56] References Cited

U.S. PATENT DOCUMENTS

| | | | |
|---|---|---|---|
| 3,738,066 | 6/1973 | Panetti | 51/178 |
| 3,888,052 | 6/1975 | Panetti | 51/281 R |
| 4,020,599 | 5/1977 | Panetti | 51/178 |
| 4,074,468 | 2/1978 | Panetti | 51/178 |
| 4,091,578 | 5/1978 | Panetti | 51/178 |
| 4,115,857 | 9/1978 | Panetti | 364/474 |
| 4,178,724 | 12/1979 | Bruno | 51/178 |
| 4,189,873 | 2/1980 | Panetti | 51/178 |
| 4,347,688 | 9/1982 | Scheuchzer et al. | 51/178 |
| 4,416,091 | 11/1983 | Panetti | 51/178 |
| 4,583,323 | 4/1986 | Jaeggi | 51/178 |
| 4,584,798 | 4/1986 | Rivoire . | |
| 4,615,150 | 10/1986 | Panetti | 51/178 |
| 4,779,384 | 10/1988 | Shoenhair et al. | 51/178 |
| 4,785,589 | 11/1988 | Bühler | 51/178 |

FOREIGN PATENT DOCUMENTS

| | | | |
|---|---|---|---|
| 0145919 | 6/1985 | European Pat. Off. | 51/178 |
| 1540376 | 9/1968 | France . | |
| 633336 | 11/1982 | Switzerland | 51/178 |
| 1151010 | 5/1969 | United Kingdom | 51/178 |
| 2121710 | 1/1984 | United Kingdom . | |

*Primary Examiner*—Robert P. Olszewski

*Attorney, Agent, or Firm*—Young & Thompson

[57] ABSTRACT

Reprofiling device of the head of at least one rail of a railway track, comprising a support carrying at least one grinding unit. The grinding unit is mounted on the support for pivotal movement about an axis parallel to the length of the rail. The unit comprises at least one motor driving at least one grinding wheel in rotation. The axis of pivoting of the grinding unit is movable both horizontally and vertically in a direction perpendicular to the length of the rail. The grinding wheel is displaceable axially relative to the grinding unit to apply the grinding wheel against the rail. The support comprises the framing of a railroad vehicle having at one of its ends at least two wheels resting each on one of the rails of the railroad track. A hinge supports the framing at its other end on a rigid frame provided with at least two wheels resting each on one rail of the railroad track. This hinge permits movement of the framing and the rigid frame relative to each other about an axis parallel to the length of the rail.

8 Claims, 6 Drawing Sheets

DEVICE FOR THE REPROFILING OF THE RAILS OF A RAILWAY TRACK

The present invention relates to the rectification of the rails of a railway track by grinding.

For reprofiling rails, machines are now used that comprise controlled pivotable grinding units, as it is thus possible to reduce the number of grinding wheels necessary for truing the profile and thereby produce compact machines. These machines having controlled pivoting grinding units, as disclosed in Swiss patent Nos. 606,616 and 633,336, have drawbacks including the need during each angular adjustment of the inclination of the grinding wheel, to reposition the grinding wheel against the rail to be ground. Moreover, the angular amplitude of pivoting of the grinding units is limited.

There is also disclosed in British patent No. 1,151,010 a device for reprofiling the head of at least one rail, comprising a support carrying at least one grinding unit pivotally mounted about an axis parallel to the length of the rail, having at least one grinding wheel driven in rotation by a motor, and means for displacing this grinding wheel axially to apply it against a side of the rail head to true the same. This known device also comprises means for displacing the pivotal axis of the grinding wheel parallel to itself, in a direction perpendicular to the length of the rail.

One problem which arises in rail reprofiling machines is the inability to grind, with one and the same grinding wheel, all sides of the had of the rail. Until all sides can be ground, the rail cannot be trued. With existing machines, this can be done only with time-consuming manual operations and clumsy grinding units which have to be adapted for movement in a direction parallel to their axis of rotation over relatively large distances. Such movement over large distances militates against the precision of the grinding.

European patent No. 0 145919 discloses a machine having grinding wheels which can pivot at a large angle, namely, about 180°, which is much greater than on existing machines, while ensuring that during pivoting the grinding wheel does not encounter obstacles along the track such as fish plates, screws and so on. Moreover, to ensure high quality grinding, it is necessary to provide that the change in inclination of the grinding wheel does not require a large correction of its axial position so as to bring it back into contact with the rail.

In all these known embodiments, the grinding units are mounted on carriages or frames suspended beneath the railroad vehicle and resting on the rails via the grinding rolls. Therefore, the grinding reference plane is defined by the rolling surface of the rail which is worked on, and not by the plane of the railroad carriage. When the rail is severely worn, the plane of the rail is so modified that reprofiling of the rail is carried out on the basis of an inexact reference plane. Moreover, thanks to the use of pivotal grinding units comprising a motor driving two grinding wheel in rotation, the height of these units requires a large clearance below the railroad vehicle and gives rise to difficulty in locating the grinding carriages beneath it.

The present invention overcomes these drawbacks by providing a reprofiling device for the head of at least one rail of a railway track, comprising a support carrying at least one grinding unit pivotally mounted about an axis parallel to the length of the rail. The grinding unit comprises at least one motor driving at least one grinding wheel in rotation, and means for displacing the grinding unit relative to the support both vertically and horizontally in directions perpendicular to the length of the rail. The grinding unit comprises means for displacing the grinding wheel parallel to its axis to apply it against the rail. The support is constituted by the framing of the railroad vehicle, which is provided at one of its ends with at least two wheels resting each on one of the rails of the railroad track and at its other end is supported by a hinge for movement about at least one axis parallel to the rail. The hinge is supported by a rigid frame having at least two wheels resting each on one rail of the railroad track. The framing thus defines a reference plane for the grinding. Each grinding unit comprises a casing connected to the framing by the means for vertically and horizontally moving the pivot axis of the grinding unit. Each grinding wheel is connected to this casing by a rotary table and by the means for displacing the grinding wheel along its axis.

The accompanying drawings show schematically and by way of example several modifications of reprofiling devices according to the invention.

The device for the reprofiling of the head of at least one rail of a railroad track comprises a support carrying at least one grinding unit. This grinding unit is pivotally mounted about an axis parallel to the longitudinal axis of the rail and has at least one motor driving at least one grinding wheel in rotation. The device further comprises means for displacing the grinding unit both horizontally and vertically in directions perpendicular to the length of the rail. The grinding unit also comprises means for displacing the grinding wheel along its axis to apply it against a rail to be ground.

Figure 1:
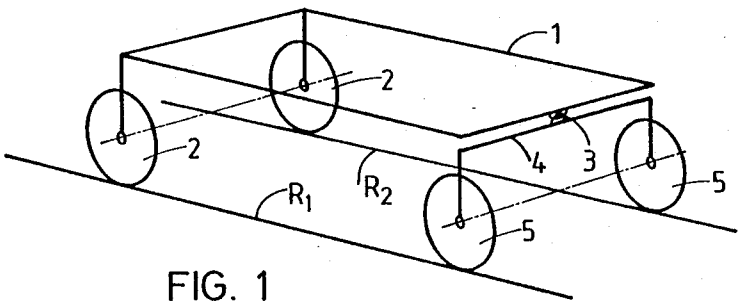
FIG. 1 is a diagram showing the arrangement of the framing of the railroad vehicle which comprises the support of the reprofiling device.

FIG. 1 shows schematically the support of the grinding units which is comprised by the frame 1 of a railroad vehicle (not shown). This framing is provided at one of its ends with at least two wheels 2 each resting on one of the rails R1, R2 of the railway track. For normal high speed operation of the vehicle, normal suspensions are provided; however, this framing comprises locking systems (not shown) for those suspensions to render them quite rigid and secure with the wheels 2 during the operation of grinding.

The other end of the framing 1 is hinged about an axis 3 parallel to the length of the rail, on a rigid frame 4 having at least two wheels 5 each resting on one of the rails R1, R2. Here also, suspensions (not shown) can be provided for the high speed operation of the vehicle, for its movement at high speed from one grinding workplace to the next. In this case, locking system cancelling the effect of these suspensions are provided, to render the frame rigid and secure with the wheels 5 during the operation of grinding. In the present embodiment, the hinge 3 is a ball and socket joint located in the vertical plane of symmetry of the framing 1.

Therefore, a novel feature of the present invention is that the support of the grinding units is directly constituted by the framing of a railroad vehicle, this framing resting on three points, namely, the two wheels 2 and the pivot 3. In this way, this framing is always parallel to the plane of the railway track. This is important, since the grinding reference basis is comprised by a plane parallel to the plane of the track and not, as in know devices, by a horizontal plane which is tangent to the rolling surface of only one rail. It is therefore possible automatically to take account of the installed position of the rail, which is not possible with existing systems. Furthermore, the reference base for the grinding operation, which is the plane defined by the framing 1 parallel to the plane of the railway track, is the same for all grinding units working on each of rails R1 and R2, which is not the case in existing devices wherein the grinding units are controlled as a function of a reference determined solely by the single rail R1 or R2 on which they operate.

Thanks to this arrangement, by which a reference basis is established which is parallel to the plane of the railway track and common to all the grinding units, it is possible to reprofile a railway track with much greater precision and to restore, not only a suitable shape of each rail alone, but also the correct position of the trued surfaces of the rectified rails relative to each other.

It will be evident that a railway track rectified in this manner much more closely resembles the original than when reprofiled with known devices. This becomes more and more important as the speeds of trains increase.

Another advantage of the present invention resides in the factor that the grinding carriages of known devices, suspended below the railway vehicles, are eliminated. Modern grinding units, and particularly those comprising two grinding wheels driven by a single motor, are large in size and can hardly be mounted below carriages which themselves are disposed below the supporting vehicle. Eliminating the carriages thus frees a great deal of space beneath the vehicle and enables the use of large grinding units.

Figure 2:
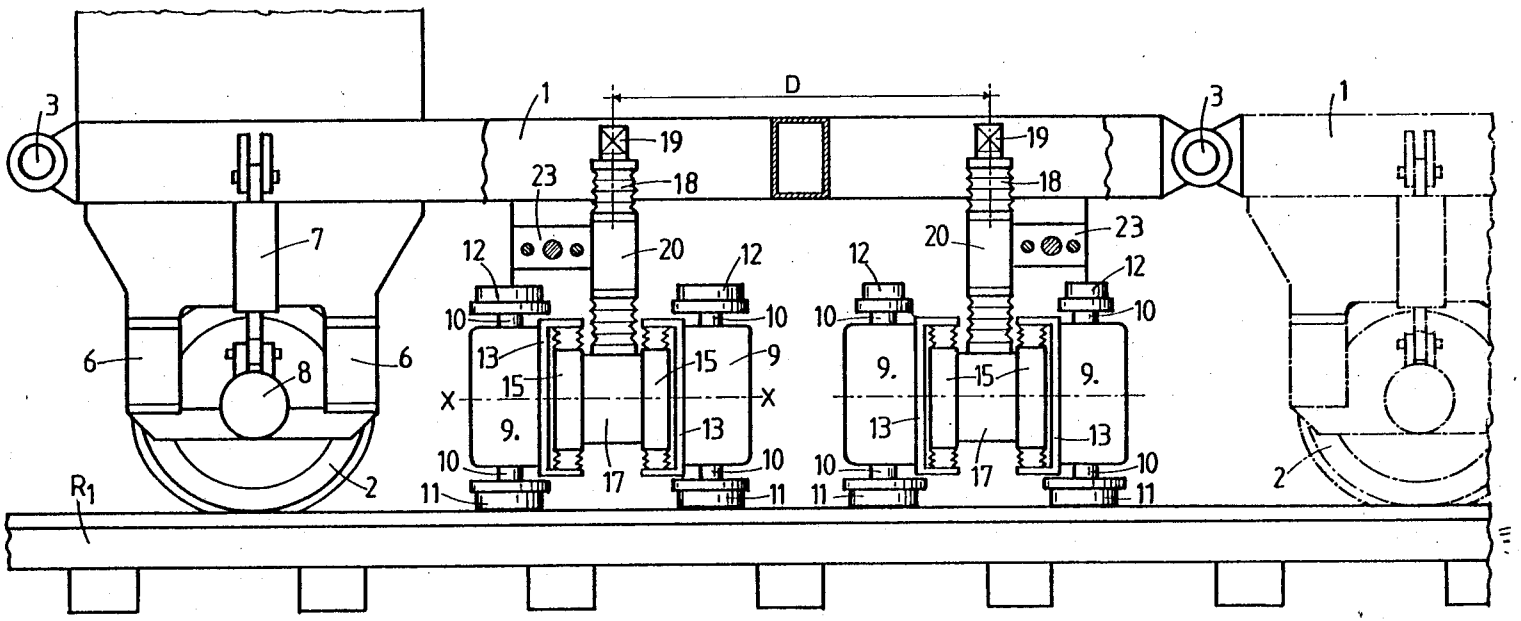
FIG. 2 is a side elevational view of the reprofiling device.

In FIG. 2 there is shown a support 1 comprised by the framing of a railroad vehicle resting on the track via wheels 2 and suspensions 6. A jack 7 connects the bearing 8 of the axle of the wheel 2 to the framing 1 and enables setting the distance between that axle and the framing thereby to lock or cancel the suspension 6.

The right end of the framing 1 is hinged by means of a ball and socket joint 3 onto the end of a framing which is identical to the preceding one and which constitutes the support 1 of the frame of the adjacent railroad vehicle.

This arrangement enables limiting the lateral displacement of the grinding units when traversing a curve in the rail.

Figure 4:
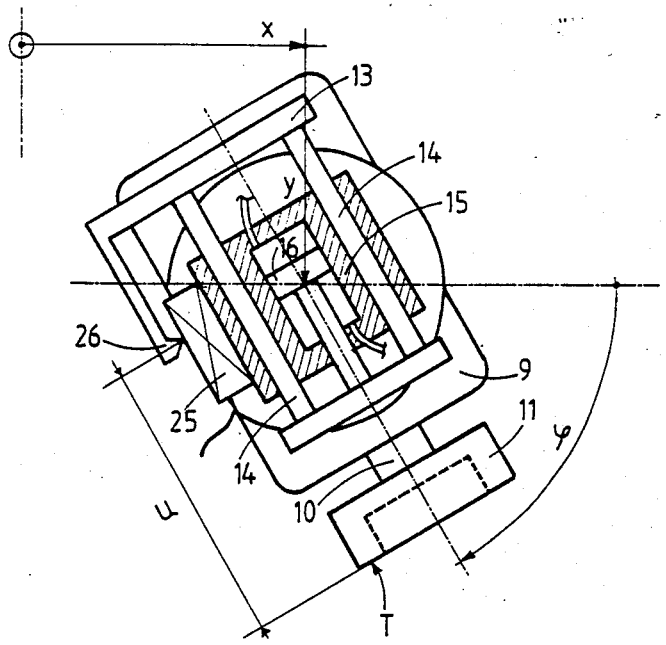
FIG. 4 shows a grinding unit in partial cross section.
Figure 5:
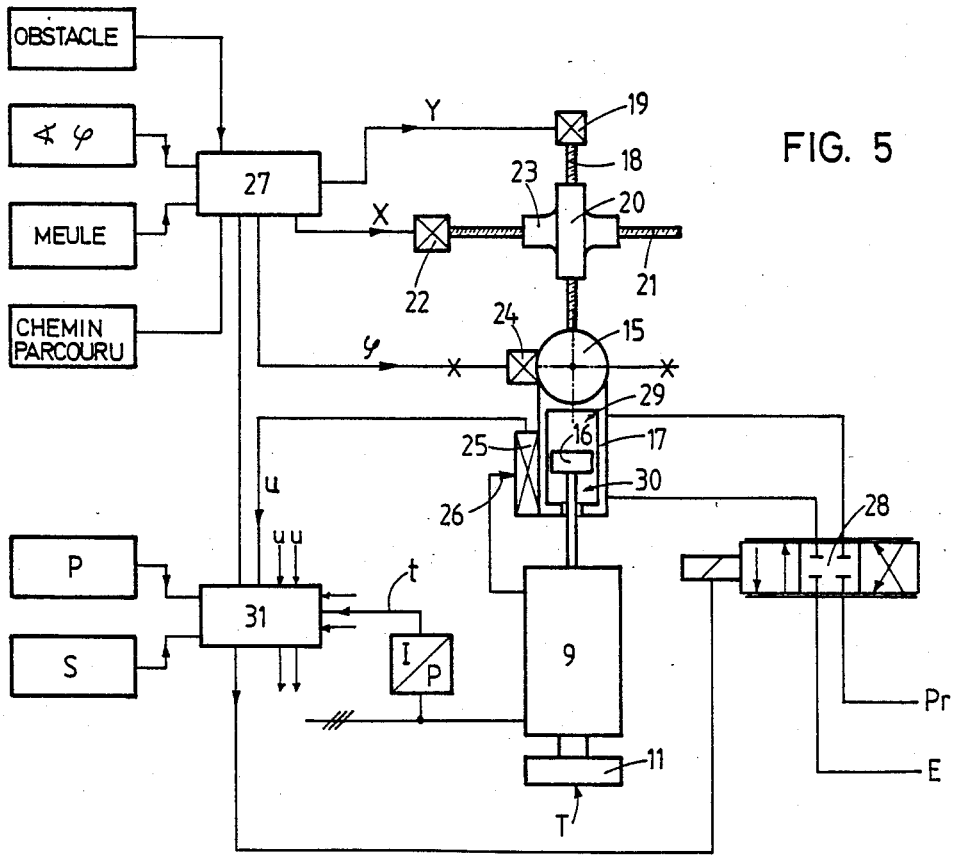
FIG. 5 is a diagram of the control device of a grinding unit.

Each grinding unit is constituted by an electric motor 9 having a motor shaft 10 which emerges from opposite sides of the casing of the motor 9. Shaft 10 carries at each of its ends a grinding wheel 11, 12 which is thereby driven in rotation. These grinding wheels 11, 12 can be identical to or different from each other. Motor 9 is secured to a stirrup 13 the legs of which are connected by means of two guide rods 14 (FIG. 4) sliding in the body 15 of a hydraulic cylinder whose piston 16 is connected to the stirrup 13. The body 15, and thereby the whole grinding unit, is mounted on a casing 17 pivotably about an axis x—x parallel to the axis of the rail R1, by means of a rotating table of known construction.

In the illustrated embodiment, two identical grinding units are mounted on the casing 17.

The casing 17 on which each grinding unit is rotatably mounted by means of a rotating table is connected to the framing 1 of the railway vehicle by means for displacing it in height, for example a screw 18 driven by a motor 19, the screw being pivotally mounted on framing 1 and meshing with a nut 20 secured to framing 1.

Figure 3:
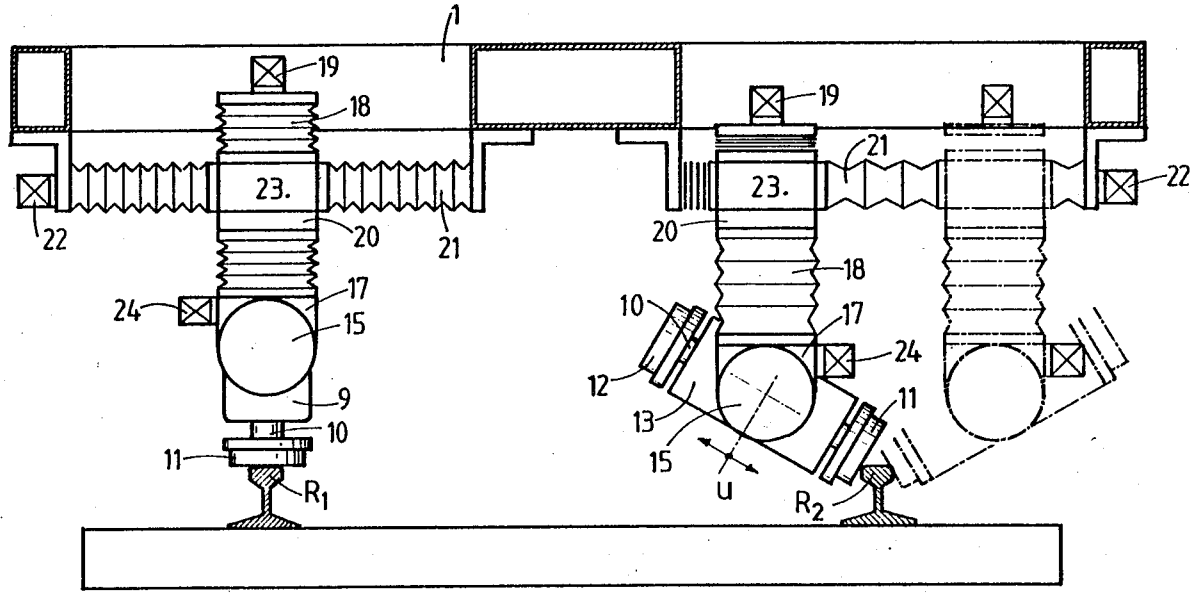
FIG. 3 is an end view of the reprofiling device.

As shown in FIG. 3, this casing 17 is also connected to the framing through means for moving the grinding unit horizontally in a direction perpendicular to the length of the rails R1, R2. A screw 21 is pivoted at its ends on the framing 1 and is driven in rotation by a motor 22. This screw 21 meshes with a nut 23 secured to the nut 20.

The rotation of the turning table of each grinding unit is controlled by a motor 24.

In association with the displacement means 14, 16 of the grinding wheel 11, measuring means are provided for measuring the distance separating the working surface T of the grinding wheel from the center of the turning table, that is from the axis x—x of pivoting of the grinding unit. Any position measuring device can be used, for example a variable potentiometer 25 secured to the body 15 of the grinding unit, having a cursor 26 secured to the stirrup 13 carrying the motor 9 driving the grinding wheel or wheels.

The control device of the grinding unit comprises a microprocessor 27 receiving signals representing the type of grinding wheel, the elapsed stroke, the location and nature of obstacles present along the track, and the grinding angle, that is, the sideline of the had of the rail on which the grinding wheel is to work.

The microprocessor 27 then delivers, as a function of these data, a signal Y controlling the motor 14 defining the height of the pivoting axis x—x of the grinding unit with respect to the framing 1; a signal X controlling the motor 22 defining the transverse position of the pivoting axis x—x of the grinding unit with respect to either the corresponding rail or the longitudinal axis of the track; and finally a signal $\phi$ controlling the motor 24 defining the angular position of the axis of rotation of the grinding wheel with respect to the reference plane defined by the framing.

Figure 7:
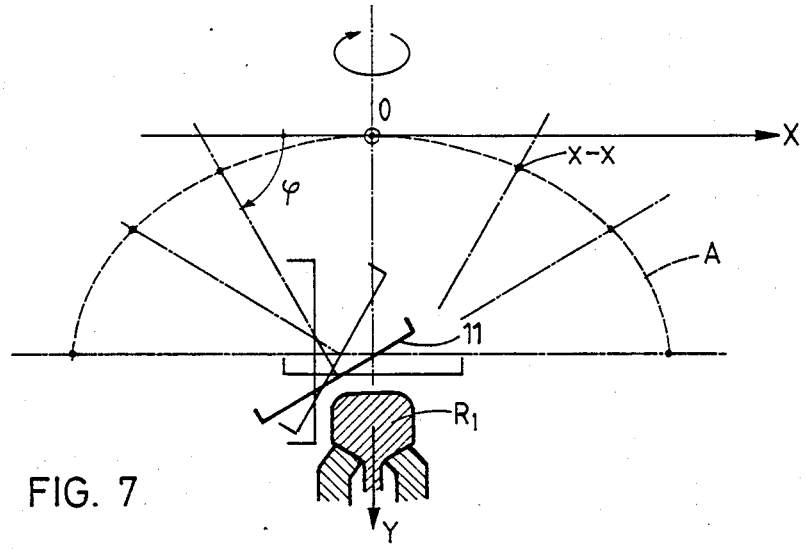
FIGS. 7 and 8 show different angular positions about the head of the rail which can be assumed by the grinding wheels of different diameters of a grinding unit, these positions being defined by the control device.
Figure 8:
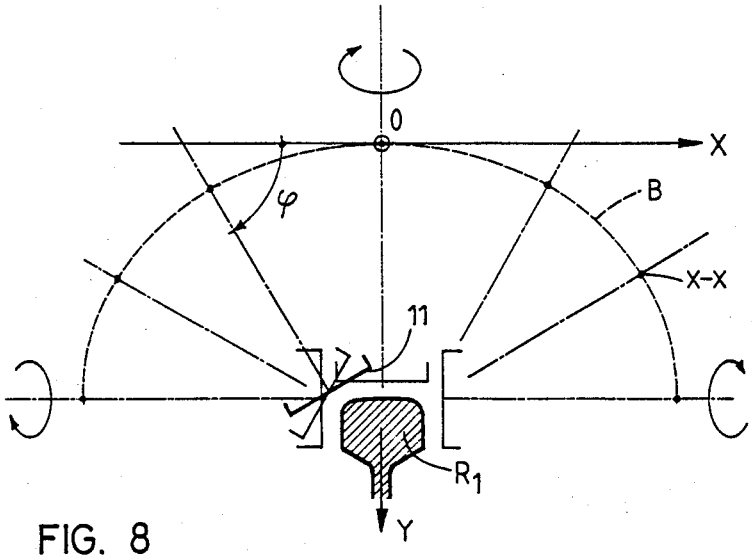

Thanks to this control device, it is possible to cause the pivoting axis x—x of the grinding wheel to follow paths A or B for example, as shown in FIGS. 7 and 8, depending on the type of grinding wheel used, to enable positioning this axis x—x as a function of the side line of the rail to be machined and of the plane of the track, as well as to control the inclination $\phi$ of the axis of rotation of the grinding wheel or in a general way the direction of displacement of this grinding wheel as caused by the jack 15, 16.

Furthermore, this microprocessor 27 makes it possible to control the lifting of the grinding unit or a modification of the angle $\phi$ to avoid an obstacle as well as to modify the paths A, B to take account of the wearing down of the grinding wheel as a function of the elapsed distances.

The pressure of the grinding wheel against the rail to be reprofiled is determined by means of the jack 15, 16 controlled by a servo-valve 28, making it possible to feed one or the other chamber 29, 30 with pressurized fluid Pr or to direct it to the exhaust E. This servo-valve 28 is driven by a microprocessor 31 receiving data relating to the grinding power P, the maximum authorized displacement S of the grinding wheel; a signal from the microprocessor 27 averaging or modulating the other data as a function of obstacles, or elapsed distance, of the grinding angle $\phi$, and of the type of wheel used. Finally, the microprocessor 31 also receives two signals representing the distance u separating the axis x—x of pivoting of the grinding wheel from the working surface T of the grinding wheel, as well as the effective grinding power t delivered by an I/P converter fed by the voltage of the grinding motor 9.

It will be evident that the microprocessors 27 and 31 can simultaneously control all the movements and displacements of several grinding units.

Figure 9:
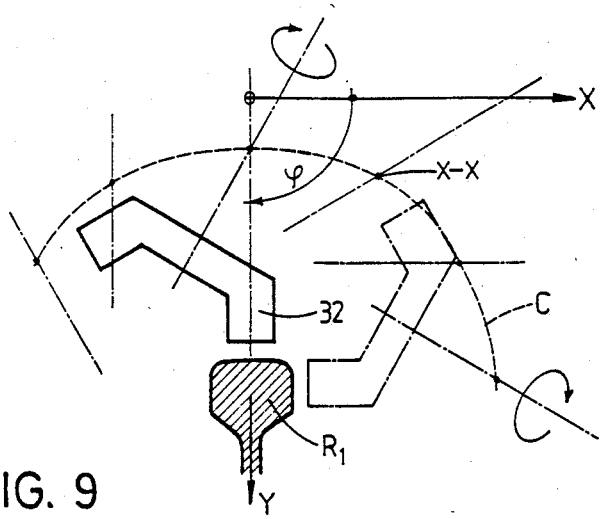
FIGS. 9 and 10 are views similar to FIGS. 7 and 8, showing profiled and peripheral grinding wheels.
Figure 10:
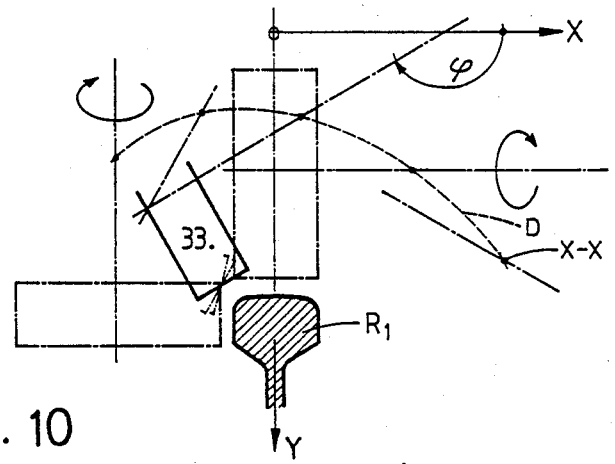

FIGS. 9 and 10 show the elapsed distances C, D traversed by the pivotal axis x—x of the grinding unit, controlled by the microprocessor 27, when the grinding wheels used are shaped wheels 32 or peripheral grinding wheels 33.

The operation of the reprofiling device of the present invention as described can be for example as follows:

Figures each of the grinding units is positioned relative to the rail to be machined, as a function of data obtained during previous measurements of the longitudinal and traverse profiles of the worn rail.

The inclination angle being determined, according to the side line to be worked on, this angle is introduced manually or automatically into the microprocessor 27. The coordinates $X=f1(\phi)$; $Y=f2(\phi)$ are calculated by this microprocessor and the grinding unit is positioned automatically as to $\phi$, x and y, as in the case of machine tools, with numeric control via signals delivered to the motors 19, 22 and 24.

The working jack 15, 16 controlled by the servovalve 28 which in turn is controlled by the microprocessor 31 displaces the grinding unit to bring the grinding wheel into contact with the rail R1 and thereafter to adjust the grinding force P. If a maximum distance between the working face T of the grinding wheel 11 with respect to the pivoting axis x—x of the grinding unit is required, the maximum stroke of the jack 15, 16 is also determined by this microprocessor 31.

A linear sensor measures the displacement U of the grinding wheel relative to its support, which is the turning table, and accordingly permits controlling its relative position.

The reference plane being determined by the rigid framing of the vehicle, the position in space of which is defined by three points, all positioning parameters of all grinding units are thereby referred to a base parallel to the plane of the railway track.

For the grinding off of short undulations, of the order of 3 cm to 30 cm for example, the coordinates $\phi$, X and Y being defined and the grinding unit being positioned as a function thereof, the jack 15, 16 controlled by the servovalve 28 associated with the regulating loop formed by the I/P converter and the microprocessor 31 enables grinding to proceed at a constant power.

For the grinding of long undulations, greater than 30 cm and perhaps of a length of several meters, it is necessary to grind only the hills and to avoid grinding the valleys of the undulations.

Figure 6:
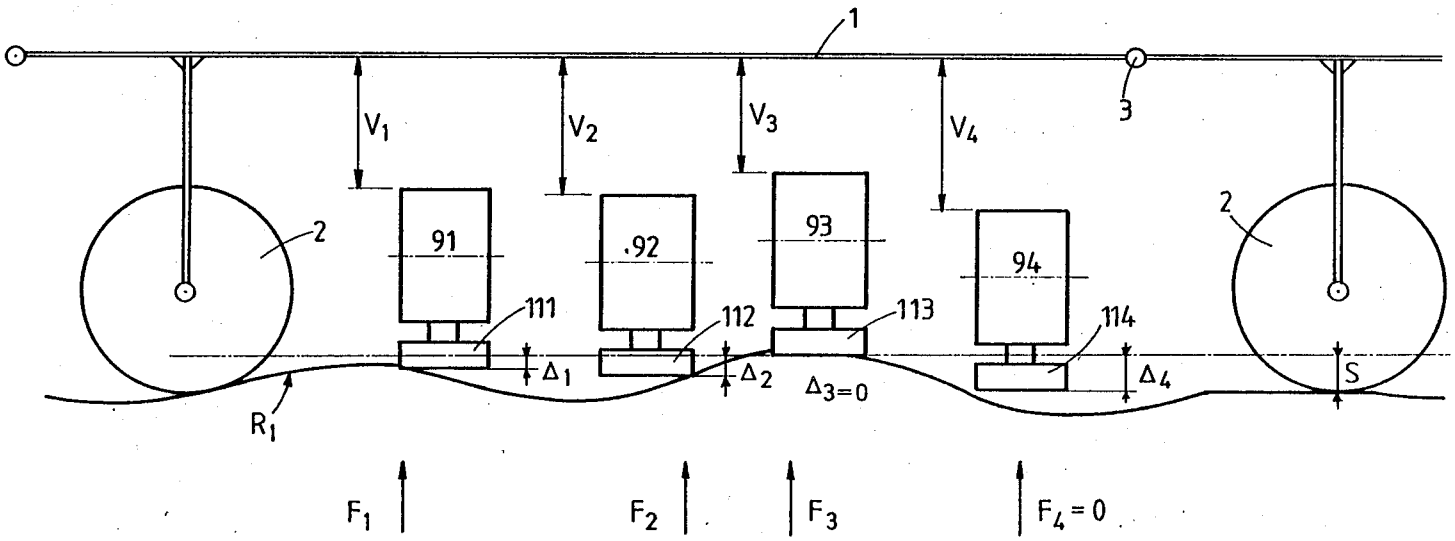
FIG. 6 shows schematically the operation of the grinding device according to the invention.

To simplify the explanation, with reference to FIG. 6, all units 91 to 94 and 111 to 114 of the same rail are taken to be located in a vertical plane passing through the axis of the rail. Their coordinates are $\phi=0$; $X=0$; $Y=0$.

The dimensions Vi representing (Yi+Ui) designate the distances of the working faces Ti of the grinding wheels relative to the reference plane defined by the framing 1 of the vehicle.

The grinding wheel 113 which is the highest defines the upper grinding limit; and the step or threshold S defines the lower limit below which it has been determined not to grind the rail. This upper limit Vi and the step S define the spectrum or range over which all the grinding units are permitted to be displaced so as to rectify the rail. The microprocessor 31 controlling the servo-valve 28 takes into account the value of the step S below which the grinding units cannot descend, and only the hills of the undulations are ground.

The units of each rail being independent, it is possible to grind one rail with a given step and the other with another step or with the same step, according to the case in question.

There is thus provided a reprofiling device of at least one head of a rail of a railway track, which controls automatically the positioning of each of the grinding units with respect to a reference base which is parallel to the plane of the track and which also automatically controls the grinding pressure and in the case of long waves, the maximum grinding depth so as to avoid grinding the valleys of the long waves.

When using grinding units comprising two or several grinding wheels driven by the same motor, it is apparent that the replacement of a grinding wheel with another is also effectuated automatically by pivoting the grinding unit.

Figure 11:
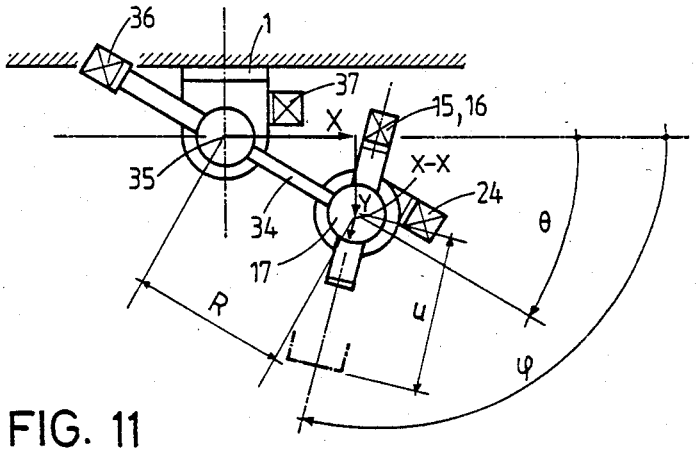
FIG. 11 shows schematically a modified form of the control system for a grinding unit.

In a modification shown in FIG. 11, the means to displace as to height and horizontally the axis of pivoting x—x of the grinding units takes a different form. The grinding unit with its displacing means of the grinding wheel actuated by the jack 15, 16 and the turning table actuated by its motor 24, is slidably mounted along an arm 34 hinged at 35 on the framing 1. A motor 36 makes it possible to vary the distance R separating the pivoting axis x—x of the grinding unit from the pivoting axis 35 of the arm. Another motor 37 permits angularly positioning this arm 34 over an angle $\theta$ with respect to the framing, and thus with respect to the reference plane. In such an embodiment, the microprocessor 27 of the control device calculates signals corresponding to the angle $\theta$ and the distance R instead of corresponding to the coordinates X, Y as before.

It will therefore be seen that this reprofiling device can be provided with any type of grinding wheel or even with several different types of grinding wheels, such as lapidary wheels, conical wheels, peripheral wheels, and that the wheels can be of any diameter.

The vehicles can be pulled or can be powered. The articulation of the vehicles to each other enables producing deflection when going about curves. Finally, the space below the vehicle is entirely free for receiving the grinding units, since it is no longer necessary to have guiding carriages for them. To enhance lateral guiding during grinding, the vehicles can be provided with lateral guiding rollers entering into contact with the inner faces of the rails.

The functions defining the relationships of X, Y and $\phi$, or R, $\theta$ and $\phi$, are memorized in the microprocessor 31 of the control device. These functions can also take into account the type of rail to be reprofiled, if desired.

I claim:

1. Reprofiling device of the head of at least one rail of a railway track comprising a support carrying at least one grinding unit pivotally mounted on a rotating table around an axis parallel to the length of the rail, said unit comprising at least one motor driving at least one grinding wheel in rotation and means for displacing both horizontally and vertically the axis of pivoting of the grinding unit perpendicular to the length of the rail; said grinding unit also comprising means for displacing the grinding wheel to apply it against the rail, the support comprising the framing of a railroad vehicle provided at one of its ends with at least two wheels resting each on one of the rails of the railroad track, hinge means supporting the framing at its other end on a rigid frame provided with at least two wheels resting each on one rail of the railroad track, said hinge means permitting movement of said framing and said rigid frame relative to each other about an axis parallel to the length of the rail, each grinding unit comprising a casing connected to the framing by said means for displacing the pivoting axis of said grinding unit; and each grinding wheel being connected to said casing by means of said rotating table and by said means for displacing the grinding wheel.

2. Device according to claim 1, wherein said rigid frame is the end of the framing of a second railroad vehicle itself provided with at least two wheels resting on the track.

3. Device according to claim 1, wherein the means for displacing the pivoting axis of the grinding unit comprise two displacement members displacing the grinding unit in conjugated movements along directions (X,Y or R, $\theta$) located in a plane perpendicular to the length of the track.

4. Device according to claim 1, further comprising a control device comprising a microprocessor fed by signals representing the type of grinding wheel used, the elapsed distance, the angle $\phi$ for grinding the rail, eventual obstacles located along the track and delivering control signals to as well as a control signal feeding a motor driving the turning table to position the grinding unit at the desired angle $\phi$, the rotation of the angle being conjugated to the displacement X, Y or R, $\theta$ of the grinding unit.

5. Device according to claim 4, wherein the control device comprises further a second microprocessor delivering a control signal of a servovalve feeding displacement means of the grinding wheel and receiving signals representing the desired grinding power in function of the position of the grinding unit.

6. Device according to claim 5, wherein the second microprocessor also receives a threshold signal defining the maximum amplitude of displacement of the grinding wheel in a band of a width equal to said threshold.

7. Device according to claim 4, wherein the control device controls all the grinding units working on the one and the other rails, the maximum amplitude of the displacements of the grinding wheel being identical for all grinding units working on the same rail.

8. Reprofiling device of the head of at least one rail of a railway track, comprising a support carrying at least one grinding unit, means mounting the grinding unit on the support for pivotal movement about an axis parallel to the length of the rail, said unit comprising at least one motor driving at lest one grinding wheel in rotation, means for displacing both horizontally and vertically said axis of pivoting of the grinding unit in a direction perpendicular to the length of the rail, means for displacing the grinding wheel axially relative to the grinding unit to apply the grinding wheel against the rail, the support comprising the framing of a railroad vehicle having at one of its ends at least two wheels resting each on one of the rails of the railroad track, hinge means supporting the framing at its other end on a rigid frame provided with at least two wheels resting each on one rail of the railroad track, said hinge means permitting movement of said framing and said rigid frame relative to each other about an axis parallel to the length of the rail.

* * * * *